US008337966B2

(12) United States Patent
Sanari

(10) Patent No.: US 8,337,966 B2
(45) Date of Patent: Dec. 25, 2012

(54) TRANSFER SHEET FOR INK JET PRINTING AND FIBER PRODUCT EQUIPPED WITH THE SAME

(76) Inventor: Katsuo Sanari, Osaka-fu (JP)

( * ) Notice: Subject to any disclaimer, the term of this patent is extended or adjusted under 35 U.S.C. 154(b) by 403 days.

(21) Appl. No.: 12/543,835

(22) Filed: Aug. 19, 2009

(65) Prior Publication Data

US 2009/0304955 A1 Dec. 10, 2009

Related U.S. Application Data

(63) Continuation-in-part of application No. 12/183,266, filed on Jul. 31, 2008, now abandoned.

(30) Foreign Application Priority Data

Mar. 28, 2008 (JP) ..... 2008-001892 U

(51) Int. Cl.
*B41M 5/00* (2006.01)

(52) U.S. Cl. ..... 428/32.6; 428/200; 428/202; 428/206; 428/213; 428/328

(58) Field of Classification Search ..... 428/32.6, 428/200, 202, 206, 213, 328
See application file for complete search history.

(56) References Cited

U.S. PATENT DOCUMENTS

| | | | | |
|---|---|---|---|---|
| 4,971,858 | A * | 11/1990 | Yamano et al. | 428/32.5 |
| 5,747,148 | A * | 5/1998 | Warner et al. | 428/212 |
| 2002/0192434 | A1 * | 12/2002 | Yuan et al. | 428/195 |
| 2003/0194523 | A1 * | 10/2003 | Kume et al. | 428/40.1 |

* cited by examiner

*Primary Examiner* — Betelhem Shewareged
(74) *Attorney, Agent, or Firm* — Rahman LLC

(57) ABSTRACT

Provided are a transfer sheet for ink jet printing capable of photographically printing on a cloth and capable of favorably keeping the texture of the cloth material and a spatial effect also after printing without generating bleeding and color fade-out with time, and a fiber product provided with the same. A transfer sheet for ink jet printing containing an ink-receiving layer, a fabric layer, the first film layer, a hot melt layer and a support.

6 Claims, 3 Drawing Sheets

TRANSFER SHEET FOR INK JET PRINTING AND FIBER PRODUCT EQUIPPED WITH THE SAME

CROSS-REFERENCE TO RELATED APPLICATIONS

This application is a continuation-in-part of U.S. patent application Ser. No. 12/183,266 filed on Jul. 31, 2008, which claims priority to Japanese Application No. 2008-001892U filed on Mar. 28, 2008, the contents of which, in their entireties, are herein incorporated herein by reference.

BACKGROUND

The present invention relates to a transfer sheet for ink jet printing and a fiber product provided with the same. More specifically, the present invention relates to a transfer sheet for ink jet printing capable of photographically printing on fabric and capable of favorably keeping texture of a cloth material also after printing without generating bleeding and color fade-out with time and a fiber product provided with the same.

Conventionally, when a pattern is directly printed on a fabric using a pigment ink, in general, there have been conventionally problems that the ink penetrates into the cloth itself with time and bleeding and the pattern become unclear. Further, although a method of coating after printing is adopted in order to solve these problems, there are problems that coating for a pigment ink is hard in this case and texture of the cloth material and a spatial effect are damaged. Further, there is a problem that the coating costs high.

SUMMARY

However, there is a problem that retention of texture of a fabric and a spatial effect after printing cannot be improved yet even if the above-mentioned thermal transfer sheet is used.

The texture of a fabric and the spatial effect after printing can be retained somewhat only for a polyester fabric by solely using sublimation transfer technology and although the once solution of the problem is enabled, the above-mentioned problems are not solved yet for various fabrics other than polyester.

The present invention has been made in view of the problems of the above-mentioned conventional printing technology, and an object of the present invention is to provide a transfer sheet for ink jet printing capable of photographically printing on a cloth and capable of favorably keeping the texture of a cloth and a spatial effect after printing also after printing without generating bleeding and color fade-out with time and fiber product provided with the same. Further, in the present invention, a cloth means a concept including a woven fabric and an unwoven fabric.

One embodiment of the transfer sheet for ink jet printing of the present invention is characterized in including an ink-receiving layer, a fabric layer, the first film layer, a hot melt layer and a support.

Further, another embodiment of the transfer sheet for ink jet printing of the present invention is characterized in that the second film layer is further formed between the ink-receiving layer and the fabric layer.

The present invention is further related to a fiber product and is characterized in that the ink-receiving layer, the fabric layer, the first film layer and the hot melt layer are provided and is characterized in that the ink-receiving layer, the second film layer, the fabric layer, the first film layer and the hot melt layer are provided.

According to the transfer sheet for ink jet printing of the present invention, printing can be photographically carried out on a cloth and the texture of a cloth and a spatial effect after printing can be favorably kept also after printing without generating bleeding and color fade-out with time. Further, a fiber product transcribing the transfer sheet for ink jet printing can be obtained.

Figure 1:
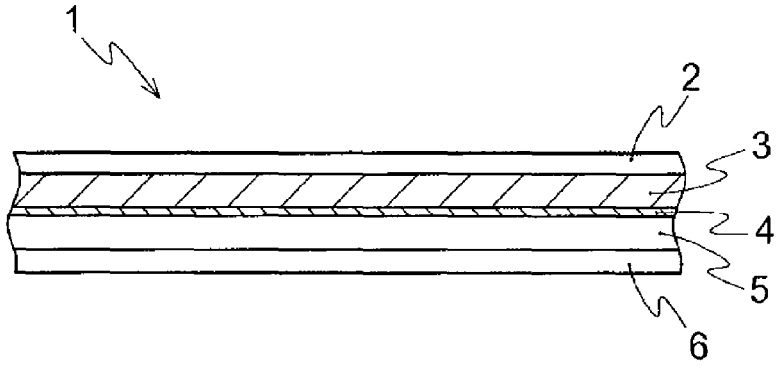
FIG. 1 is a cross-sectional view of the transfer sheet for ink jet printing in one embodiment (Embodiment 1) of the transfer sheet for ink jet printing of the present invention.

EXPLANATION OF SYMBOLS:

1 and 8 Transfer sheet for ink jet printing
2 and 13 Ink-receiving layer
3 Fabric layer
4 First film layer
5 and 12 Hot melt layer
6 and 11 Support
7 Fiber products
9 Second film layer
10 Thermal transfer sheet
15 metal piece
16 top coat

DETAILED DESCRIPTION

The transfer sheet for ink jet printing related to an embodiment of the present invention and fiber product provided with the same are illustrated below in detail according to the attached drawings.

Figure 2:
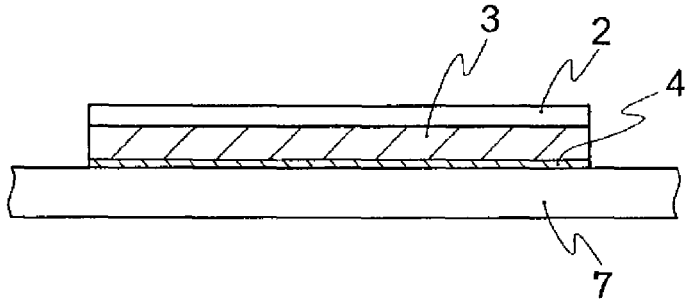
FIG. 2 is a cross-sectional view of the fiber product in one embodiment (Embodiment 1) of the fiber product of the present invention.
Figure 3:
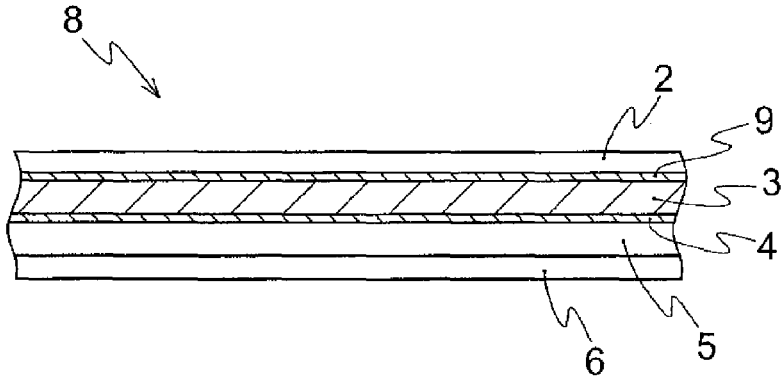
FIG. 3 is a cross-sectional view of the transfer sheet for ink jet printing in one embodiment (Embodiment 2) of the transfer sheet for ink jet printing of the present invention.
Figure 4:
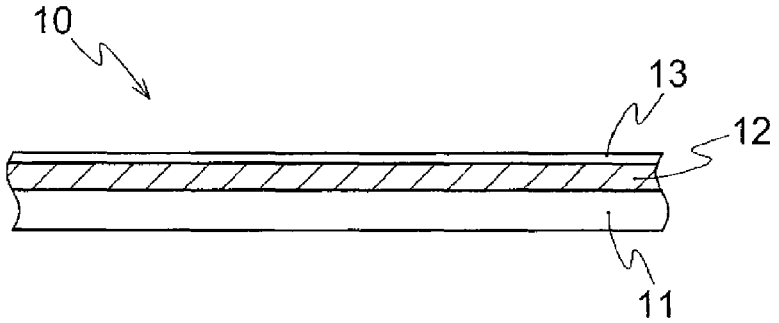
FIG. 4 is a cross-sectional view of a conventional transfer sheet.

FIG. 1 is a cross-sectional view of the transfer sheet for ink jet printing in one embodiment (Embodiment 1) of the transfer sheet for ink jet printing of the present invention. FIG. 2 is a cross-sectional view of the fiber product in one embodiment (Embodiment 1) of the fiber product of the present invention. FIG. 3 is a cross-sectional view of the transfer sheet for ink jet printing in one embodiment (Embodiment 2) of the transfer sheet for ink jet printing of the present invention. FIG. 4 is a cross-sectional view of a conventional transfer sheet.

A pattern can be prevented from bleeding and becoming an unclear pattern without carrying out coating by using a thermal transfer sheet 10 shown in FIG. 4. Namely, in the thermal transfer sheet 10 shown in FIG. 4, a hot melt layer 12 and an ink-receiving layer 13 are formed on a support 11 and a picture and a pattern are printed on the ink-receiving layer 13. Further, when the hot melt layer 12 is pushed on the cloth surface of a fiber product after peeling the support 11 and heating is carried out by an iron, the hot melt layer 12 is melted, adheres on the fiber product and penetrates into it. Thus, the ink-receiving layer 13 having a picture and a pattern can be fixed on the cloth surface of the fiber product by the hot melt layer 12.

Embodiment 1

As shown in FIG. 1, the transfer sheet 1 for ink jet printing related to the present embodiment contains an ink-receiving layer 2, a fabric layer 3, the first film layer 4, a hot melt layer 5 and a support 6.

The ink-receiving layer 2 is a layer receiving and fixing an ink. Examples of materials of the ink-receiving layer 2 include resins such as an acryl resin, a urethane resin or an ester resin. Further, when a picture and a pattern are printed with an aqueous ink, for example, aqueous cationic polymers such as aqueous urethane and aqueous acryl and oil polymers can be used.

Further, these materials may be suitably selected depending on the kind of ink and respective various materials obvious to those skilled in the art can be suitably selected. The ink-receiving layer 2 can be molded on the fabric layer 3 described later by usual printing methods such as a gravure printing method and a screen printing method or a roll coater method. Further, the thickness of the ink-receiving layer 2 is preferably 30 to 100 μm. When the thickness of the ink-receiving layer 2 is thinner than this range, the reception of an ink tends to be difficult. Further, when the thickness of the ink-receiving layer 2 is thicker than this range, the ink-receiving ability is not enhanced and inversely, the cloth texture of the fabric layer 3 described later tends to be damaged.

Figure 5:
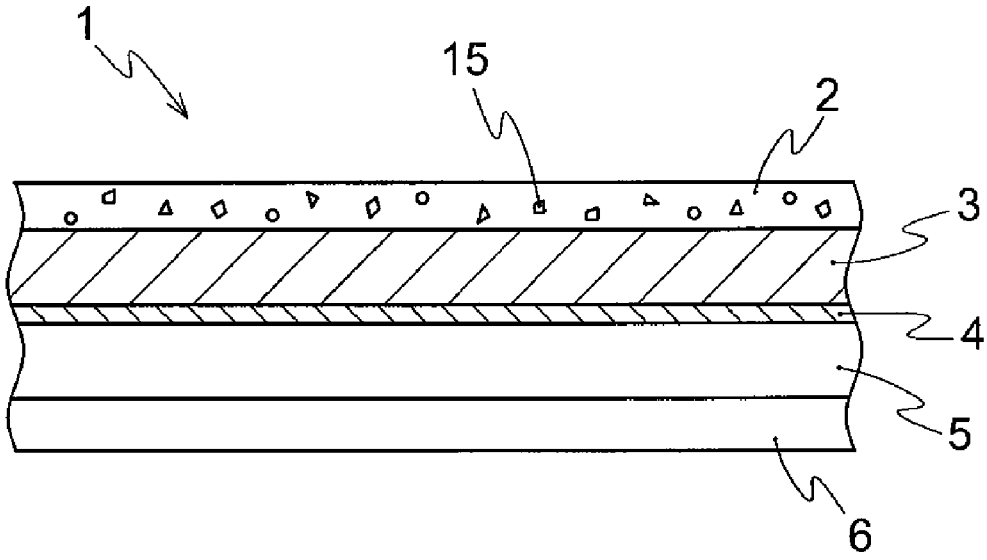
FIG. 5 is a cross-sectional view of the transfer sheet for ink jet printing in one embodiment (Embodiment 1) of the transfer sheet for ink jet printing of the present invention.
Figure 6:
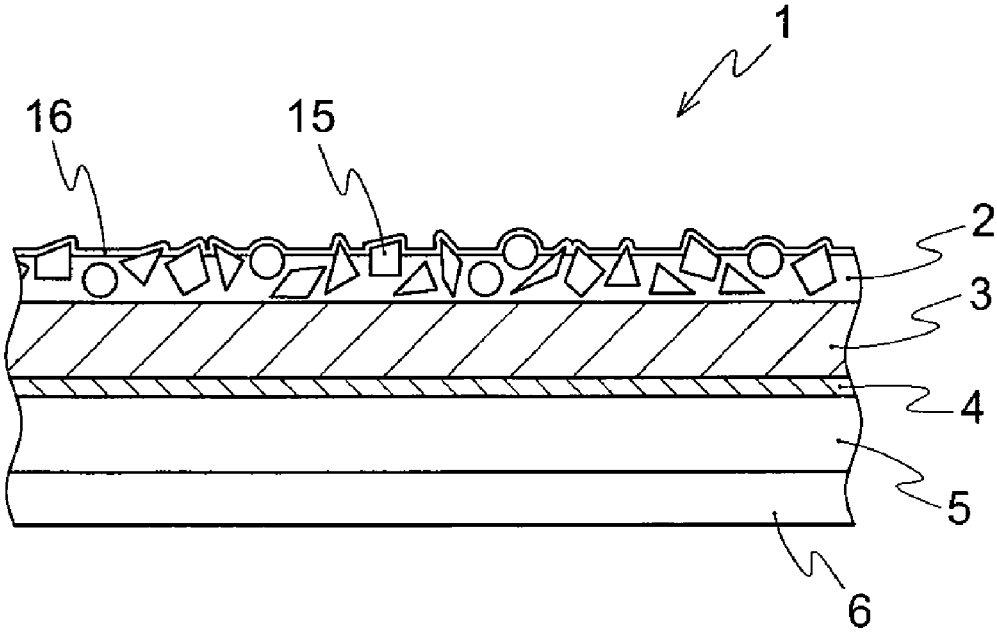
FIG. 6 is a cross-sectional view of the transfer sheet for ink jet printing in one embodiment (Embodiment 1) of the transfer sheet for ink jet printing of the present invention.

The ink-receiving layer 2 of the present embodiment can be formed by mixing metal pieces 15 prepared by pulverizing metal powder and metal foil. A kind of metal is not specifically limited so far as it exhibits metallic gloss, and examples thereof include gold, silver and aluminum. Among these, aluminum is preferable from the viewpoint that visibility is good. When a picture and a pattern are printed by an ink jet method on the ink-receiving layer 2 thus obtained, a portion not provided with an ink can be expressed as silver, a portion provided with yellow ink can be expressed as gold, and other colors can be expressed as metallic tone. The size of the metal piece 15 is preferably 10 to 2000 μm. As shown in FIG. 5 and FIG. 6, it is able to disperse the metal pieces 15 in the ink-receiving layer 2 or protrude the metal pieces 15 from the ink-receiving layer 2. It is able to prepare the top coat 16 on the surface of ink-receiving layer 2 to adjust the texture. Examples of a material of the top coat 16 include plastics such as urethane or the like, but the top coat 16 in the present embodiment is not limited thereto. For instance, when the fiber product of the present invention is used for cloth for medical expert and then the cloth is disinfected by 80° C. boiled water, the fiber product of the present invention is not spoiled because the fiber product of the present invention is coated by top coat 16.

The method for mixing the metal piece 16 to the material resin of ink-receiving layer 2 is not limited. It is able to mix the metal pieces 16 to the material of the ink-receiving layer 2 by agitator. If necessary, it is able to use toluene or isopropyl alcohol or the like as a diluent. It is also able to coat or spray the metal pieces 16 to ink-receiving layer 2.

The fabric layer 3 provides cloth texture to the transfer sheet 1 for ink jet printing of the present invention. As described above, a conventional thermal transfer sheet has great difference between cloth texture inherent to the transferred cloth itself and touch feeling inherent to the thermal transfer sheet after being transferred to the cloth, and only the section is hard, deficient in flexibility and generates uncomfortable feeling, but the difference of touch feeling with the cloth to be transferred is extinguished by providing the fabric layer 3 in the same manner as the present embodiment and both of dough feeling and flexibility do not generate uncomfortable feeling. As a material of the cloth, all woven fabrics and non-woven fabrics can be used, and for example, synthetic fiber, silk cotton and wool can be used. Further, the fabric layer 3 of the present invention is not limited to these various materials obvious to those skilled in the art can be used. If necessary, it is able to treat the surface of the fabric layer 3, for instance, emboss finishing is available.

The first film layer 4 is a layer provided between the fabric layer 3 and the hot melt layer 5 and provided for preventing excessive penetration of an ink received by the ink-receiving layer 2, and for preventing the time lapse ravel of the fabric layer 3. Examples of a material of the first film layer 4 include plastics such as a urethane, polypropylene and polyethylene, but the first film layer 4 in the present embodiment is not limited thereto, and these various materials obvious to those skilled in the art can be used. Further, the thickness of the first film layer 4 is preferably 10 to 30 μm. When the thickness of the first film layer 4 is thinner than this range, the ravel prevention of the fabric layer 3 tends to be inadequate. Further, when the thickness of the first film layer 4 is thicker than this range, the cloth texture of the fabric layer 3 tends to be damaged. Further, although it is described in the present invention that the first film layer 4 is an essential constitution, it is clear that the problem of excessive penetration of an ink and the problem of ravel of the fabric layer 3 may be suitably abbreviated because the adjustment of ink quantity and the fixation to a cloth of the hot melt layer 5 by melting are adequate or the excessive penetration of ink and ravel do not always occur depending on environment in which the transfer sheet 1 for ink jet printing of the present invention and the fiber product 7 using thereof are used.

The hot melt layer 5 is fused by heat and pastes the fiber product 7 with the transfer sheet. A material of the hot melt layer 5 is preferably a thermoplastic resin such as polyethylene, polyurethane, polyester, polyamide, polyolefin and EVA (an ethylene-vinyl acetate copolymer). Among these, polyester and polyurethane are preferable from the viewpoint of being fused at a high temperature. Further, a material of the hot melt layer 5 of the present embodiment is not limited to these, and various materials obvious to those skilled in the art can be used. Further, the thickness of the hot melt layer 5 is not specifically limited, but is preferably 50 to 150 μm. When thickness is thinner than 50 μm, adequate adhesive property for the fiber product 7 does not tend to be obtained and when it exceeds 150 μm, the appearance of the obtained fiber product 7 tends to be damaged. Further, the hot melt layer 5 can be molded on the support 6 by usual printing methods such as a gravure printing method, and a screen printing method or a roll coater method.

The support 6 (separator) supports the ink-receiving layer 2, the fabric layer 3, the first film layer 4 and the hot melt layer 5 and is removed by peeling before transcription. Further, it is also used for cutting the sheet at half-cut by a plotter and a laser plotter. A material of the support 6 is preferably a paper such as a craft paper or a resin film and a peeling layer by silicon or a fluorine resin may be provided on surface so that peeling from the hot melt layer 5 can be easily carried out. Further, examples of the above-described resin film include a polyethylene terephthalate film, acrylonitrile-butadiene-styrene film and polypropylene film, but the resin film in the present embodiment is not limited to these and these various films obvious to those skilled in the art can be used. Further, the thickness of the support 6 is preferably 100 to 150 μm in the case of paper and preferably 75 to 100 μm in the case of the resin film. When the thickness of the support 6 is thinner than this range, the support of respective layers laminated on the support 6 tends to be difficult. Further, since it has not specific advantage to make the thickness of the support 6 thicker than this range, it is unnecessary.

Then, the fiber product 7 using the transfer sheet 1 for ink jet printing of the present embodiment are illustrated.

The fiber product 7 as shown in FIG. 2 is obtained by peeling the support 6 of the transfer sheet 1 for ink jet printing related to the present embodiment, laminating it on the surface of a cloth and pasting it by thermal pressure.

As the transcription method, there are mentioned methods such as a method by an iron and a method of rolling a heating roller while rolling it and clamping it. A transcription condition can be suitably selected depending on a kind of the hot melt layer 5, but a temperature is preferably 130 to 160° C. and a time is preferably 10 to 30 sec. When a heating temperature is less than 130° C., the adhesion of the transfer sheet tends to be inadequate, and when it exceeds 160° C., the fiber product 7 tends to be deteriorated. Further, transcription can be carried out even at the temperature condition of 80° C. by adjusting amounts of a curing agent and a crosslinking agent mixed with the hot melt layer 5. In other words, the transcription can be carried out based on the condition of relatively lower temperature of about 80 to 100° C. for the PVC products or the leather products such as made of PVC.

Figure 7:
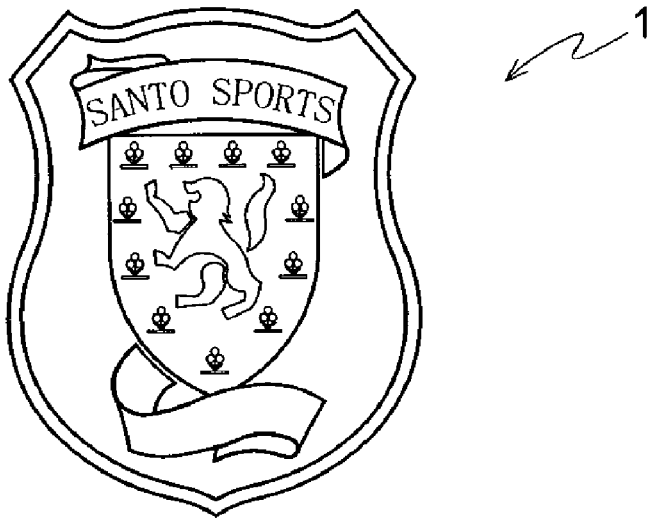
FIG. 7 is an elevational view of the transfer sheet for ink jet printing in one embodiment (Embodiment 1) of the transfer sheet for ink jet printing of the present invention.
Figure 8:
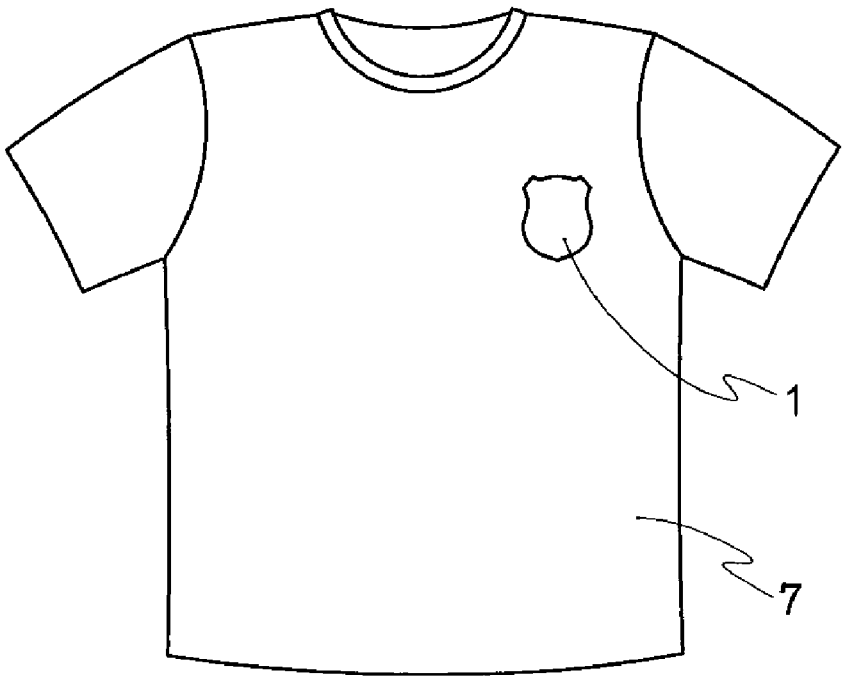
FIG. 8 is an elevational view of the fiber product in one embodiment (Embodiment 1) of the fiber product of the present invention.

Further, when the fiber product 7 is obtained, it is preferable that a retack film is pasted on the surface (on the ink-receiving layer 2) of the transfer sheet 1 for ink jet printing after peeling the support 6. The printing can prevent the peeling by friction at preparation of the fiber product 7, by pasting the retack film. Further, when the fiber product 7 in which flying patterns are arranged are wanted to be prepared, the fiber product 7 can be prepared by using the retack film, while retaining the desired positional relation of respective pictures and patterns. The concrete example of the cut transfer sheet 1 and the fiber product 7 is shown in FIG. 7 and FIG. 8. As shown in FIG. 7, it is able to print the pattern or character on the ink-receiving layer 2. As shown in FIG. 8, for instance, it is able to use the fiber product 7 as the emblem at region of chest. The position and size of the cut transfer sheet 1 is not limited and it is able to put the cut transfer sheet 1 at region of back or sleeve of the fiber product 7.

Embodiment 2

As shown in FIG. 3, the transfer sheet 8 for ink jet printing of the present Embodiment 2 is the same except that the second film layer 9 is further formed between the ink-receiving layer 2 and the fabric layer 3 in the transfer sheet 1 for ink jet printing related to the present Embodiment 1.

The second film layer 9 is provided for preventing excessive penetration of an ink received on the ink-receiving layer 2. The provision of the second film layer 9 in the present embodiment is carried out when an ink is excessively penetrated in spite of providing only the first film layer 4, and is particularly useful in the case that cloth texture is damaged when the thickness of the first film layer 4 is thickened in order to prevent it. Namely, the penetration of an ink is adjusted by using two films and thickness not damaging the cloth texture is finely adjusted. Examples of the material of the second film layer 9 include plastics such as a urethane, polypropylene and polyethylene, but it is not limited thereto in the same manner as the first film layer 4, and various materials obvious to those skilled in the art can be used. Further, the thickness of the second film layer 9 is preferably at most 30 μm. When the thickness of the second film layer 9 is thicker than this value, cloth texture of the fabric layer 3 tends to be damaged.

Further, since the description of the fiber product using the transfer sheet 1 for ink jet printing of the present embodiment is quite the same as that of the preparation method of the fiber product 7 in Embodiment 1, description is abbreviated.

What is claimed is:

1. A transfer sheet for ink jet printing for adhering to clothing, comprising:
- an ink-receiving layer;
- a fabric layer proximate to said ink-receiving layer;
- a first film layer adjacent to said fabric layer, wherein a thickness of said first film layer is in the range of 10 to 30 μm;
- a hot melt layer adjacent to said first film layer, wherein said hot melt layer comprises a thermoplastic resin that is fused by heat and pasting said clothing with said transfer sheet; and
- a support adjacent to said hot melt layer.

2. The transfer sheet for ink jet printing of claim 1, further comprising a second film layer positioned between said ink-receiving layer and said fabric layer.

3. Clothing having a transfer sheet printed with ink jet, said clothing comprising:
- a transfer sheet for ink jet printing comprising:
  - an ink-receiving layer;
  - a fabric layer proximate to said ink-receiving layer;
  - a first film layer adjacent to said fabric layer, wherein a thickness of said first film layer is in the range of 10 to 30 μm; and
  - a hot melt layer made of a thermoplastic resin, wherein said hot melt layer is positioned adjacent to said first film layer,
- wherein said transfer sheet is adhered to said clothing by fusing said hot melt layer by heating said hot melt layer at a temperature of 130° C. to 160° C.

4. Clothing having a transfer sheet printed with ink jet, said clothing comprising:
- a transfer sheet for ink jet printing comprising:
  - an ink-receiving layer;
  - a fabric layer proximate to said ink-receiving layer;
  - a first film layer adjacent to a reverse surface of said fabric layer and positioned at an opposite side of said ink-receiving layer, wherein a thickness of said first film layer is in the range of 10 to 30 μm;
  - a second film layer positioned between said ink-receiving layer and said fabric layer; and
  - a hot melt layer made of a thermoplastic resin and positioned adjacent to said first film layer,
- wherein said transfer sheet is adhered to said clothing by fusing said hot melt layer by heating said hot melt layer at a temperature of 130° C. to 160° C.

5. The transfer sheet for ink jet printing of claim 1, wherein said ink-receiving layer is formed by mixing metal pieces together.

6. The transfer sheet for ink jet printing of claim 5, further comprising a top coat on a surface of said ink-receiving layer.

* * * * *